US006819256B2

(12) United States Patent
Hampton

(10) Patent No.: US 6,819,256 B2
(45) Date of Patent: Nov. 16, 2004

(54) PROVIDING A REMINDER MESSAGE DEPENDING ON AN ENVIRONMENT

(75) Inventor: Art Hampton, Wildwood, IL (US)

(73) Assignee: Motorola, Inc., Schaumburg, IL (US)

( * ) Notice: Subject to any disclaimer, the term of this patent is extended or adjusted under 35 U.S.C. 154(b) by 13 days.

(21) Appl. No.: 10/328,533

(22) Filed: Dec. 24, 2002

(65) Prior Publication Data

US 2004/0119600 A1 Jun. 24, 2004

(51) Int. Cl.[7] ..... G08B 3/00

(52) U.S. Cl. ..... 340/691.6; 340/321; 340/539.11; 340/540; 340/692

(58) Field of Search ..... 340/692, 691.1, 340/686.1, 540, 691.6, 321, 326, 539.11, 988, 996

(56) References Cited

U.S. PATENT DOCUMENTS

| | | | | |
|---|---|---|---|---|
| 5,642,303 | A * | 6/1997 | Small et al. | 708/109 |
| 6,177,905 | B1 * | 1/2001 | Welch | 342/357.13 |
| 6,360,101 | B1 | 3/2002 | Irvin | 455/456 |
| 6,392,548 | B2 | 5/2002 | Farringdon et al. | 340/573.1 |
| 6,411,899 | B2 | 6/2002 | Dussell et al. | 701/211 |
| 6,433,685 | B1 | 8/2002 | Struble et al. | 340/571 |
| 6,434,256 | B1 | 8/2002 | Yeo | 382/104 |
| 6,437,696 | B1 | 8/2002 | Lemelson et al. | 340/573.4 |
| 6,515,585 | B2 * | 2/2003 | Yamamoto | 340/539.1 |
| 6,680,675 | B1 * | 1/2004 | Suzuki | 340/988 |
| 2001/0028304 | A1 * | 10/2001 | I'Anson et al. | 340/539 |
| 2002/0067308 | A1 | 6/2002 | Robertson | 342/357.17 |
| 2002/0086680 | A1 * | 7/2002 | Hunzinger | 455/456 |
| 2002/0115436 | A1 | 8/2002 | Howell et al. | 455/426 |
| 2002/0194246 | A1 * | 12/2002 | Moskowitz et al. | 709/102 |
| 2003/0043070 | A1 * | 3/2003 | Soliman | 340/686.1 |
| 2003/0224762 | A1 * | 12/2003 | Lau et al. | 455/412.2 |

FOREIGN PATENT DOCUMENTS

| | | |
|---|---|---|
| EP | 1 008 946 A1 | 6/2000 |
| WO | WO 00/41428 | 7/2002 |

* cited by examiner

*Primary Examiner*—Thomas J Mullen, Jr.
(74) *Attorney, Agent, or Firm*—Posz & Bethards, PLC; Charles W. Bethards

(57) ABSTRACT

A user device 200 and corresponding method, is arranged for providing, dependent on an environment of the user device, a reminder message for a user of the device. The device includes a receiver 205 for detecting, when present, an external signal; a controller 209 for determining when the presence of the external signal has changed; and retrieving, if so, a reminder message associated with the user device; and a user interface 211, coupled to the controller, for providing the reminder message in a user perceptible form.

21 Claims, 3 Drawing Sheets

PROVIDING A REMINDER MESSAGE DEPENDING ON AN ENVIRONMENT

FIELD OF THE INVENTION

This invention relates in general to communication equipment, and more specifically to a methods and apparatus for providing a reminder, such as a reminder message, where the providing is dependent on the environment, such as the presence of a signal from an apparatus or device, such as a gateway, access point, or other predetermined apparatus.

BACKGROUND OF THE INVENTION

Various approaches exist for providing reminders or reminder messages to people who may get distracted or otherwise forget to do something that needs to be done, such as an errand or attending a meeting and the like. Most are familiar with the string, or post it notes, or calendar application that causes a reminder message to pop up on a computer or pager or the like at a designated time or times. Of course for the reminder message to be most effective it needs to be not only timely but also otherwise relevant. There are methods that use coordinates from a GPS (Global Positioning System) receiver and provide reminders when the coordinates are appropriate. This may be satisfactory if you have a working GPS receiver, are not interested in reminders while indoors, and relevant positions are more or less static. Unfortunately that is not the case for the vast majority of individuals who may want an effective system and method for providing relevant reminder messages. A need exists for devices and methods of providing reminder messages based on a user's environment.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION OF PREFERRED EMBODIMENTS

Figure 1:
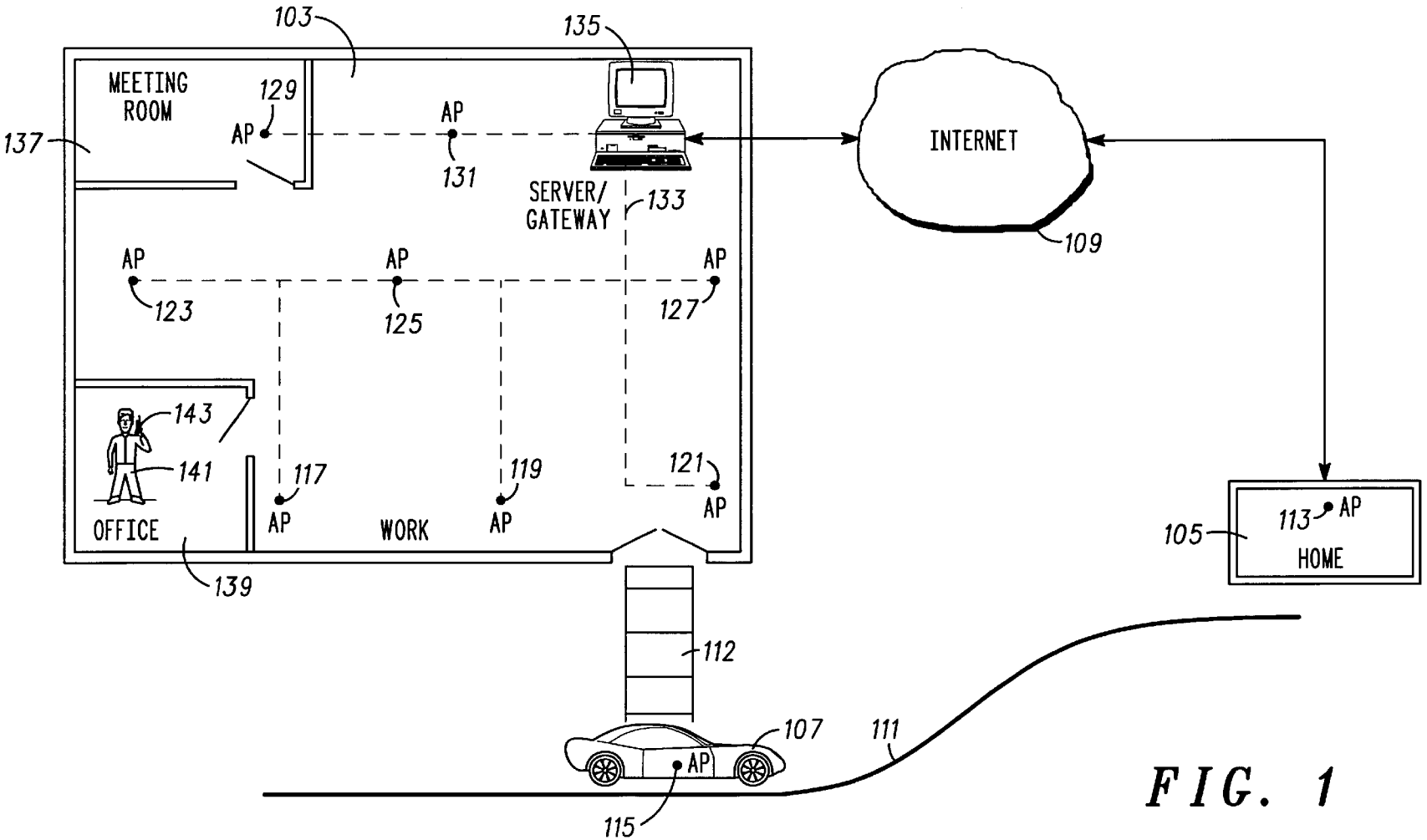
FIG. 1 depicts, a simplified and exemplary diagram for setting the context within which a user device for providing reminder messages operates.

In overview, the present disclosure concerns systems, apparatus and methods that provide services and specifically reminder services for user devices such as Personal digital assistants or cellular handsets, units, or devices and the like. More particularly various inventive concepts and principles embodied in apparatus and methods for providing a reminder message dependent on an assessment of the environment, such as the presence or absence of a signal or predetermined signal or change in the presence of such a signal at a user device are discussed and described. The communications systems and units of particular interest are those being deployed and developed including user devices or units that are able to access or at least recognize various wireless local area networks and access points therefor, such as 802.11, Bluetooth, HiprLan capable devices or variations and evolutions thereof. Note these may be multi-function devices such as cellular handsets suitable for use on one or more systems such as GSM (Global Standard for Mobile communications), GPRS (General Packet Radio System), IS-95 CDMA (Code Division Multiple Access), CDMA 2000, integrated digital enhanced network (IDEN), 2.5G or EDGE, and 3G or W-CDMA (Wideband CDMA) (UMTS) systems or variations and evolutions thereof that are suitable for providing services to cellular communications units.

As further discussed below various inventive principles and combinations thereof are advantageously employed to choose and provide for user consumption a reminder or reminder message dependent upon the presence of various factors such as a signal within an area, thus alleviating various problems, such as lack of necessary coverage and associated expenses of a GPS receiver associated with known approaches, while still facilitating appropriate reminders in a timely and otherwise appropriate manner, provided these principles or equivalents thereof are utilized.

The instant disclosure is provided to further explain in an enabling fashion the best modes of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms, if any, such as first and second, top and bottom, and the like are used solely to distinguish one from another entity or action without necessarily requiring or implying any actual such relationship or order between such entities or actions. Much of the inventive functionality and many of the inventive principles are best implemented with or in software programs or instructions and integrated circuits (ICs) such as application specific ICs. It is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation. Therefore, in the interest of brevity and minimization of any risk of obscuring the principles and concepts according to the present invention, further discussion of such software and ICs, if any, will be limited to the essentials with respect to the principles and concepts used by the preferred embodiments.

Referring to FIG. 1, a simplified and exemplary diagram for setting the context within which user devices and corresponding methods operate to provide reminder messages will be discussed and described. FIG. 1 shows a work place 103 or business and a home 105 as well as a means for transportation, such as an automobile 107. The work place 103 and home 105 are each coupled to a wide area network, such as the Internet 109 and additionally a user via the automobile can travel on a road 111 between the home and the work place where a short walk 112 places the user at the work place. The home 105 is shown with an access point 113 that is preferably a wireless access point, such as an IEEE 802.11, HiprLan or Bluetooth enabled local area access point. The automobile is likewise shown with an access point 115. Additionally, the work place 103 includes a plurality of access points 117–131 that are each coupled via a network 133 (dotted line) to each other and a server/gateway 135 to form a local area network (LAN) or, preferably, a wireless LAN to provide connectivity to employees and the like while at the workplace. Also depicted are a meeting room 137 and an office 139. The user 141 and a user device 143, such as a cellular handset, personal digital assistant, messaging device, portable computer, or the like, are also shown in the office.

Most people have had the experience of leaving home, work, or a car and so on and forgetting to take something with them. Even those few, who have never forgotten, have worried about forgetting and all of us have tried various techniques to remind us of some task that is situation or circumstance specific such as when departing one locale for another. For example, when leaving home for work, we often have something out of the ordinary that we need to remember to bring with us, such as a gift for a co-worker or some item to facilitate running some errand on the way to and from work. Similarly when departing the office for a meeting or to return home there is likely to be something that we need to remember to do, such as take a report to the meeting or pick up some groceries on the way home. The present disclosure discusses various inventive concepts, principles, devices and techniques that advantageously assist with these everyday situations where a reminder message would help out a user or individual with other things on their mind or who is otherwise prone to forgetting some of the everyday things. These devices and techniques take advantage of the changing presence (availability and absence) of external signals that surround the user and change as the user moves about. For example, when the user leaves or arrives home the presence of signals from the access points 113, 115 will likely change from being available to being absent or not available, or vice versa depending on whether the user is coming or going.

Figure 2:
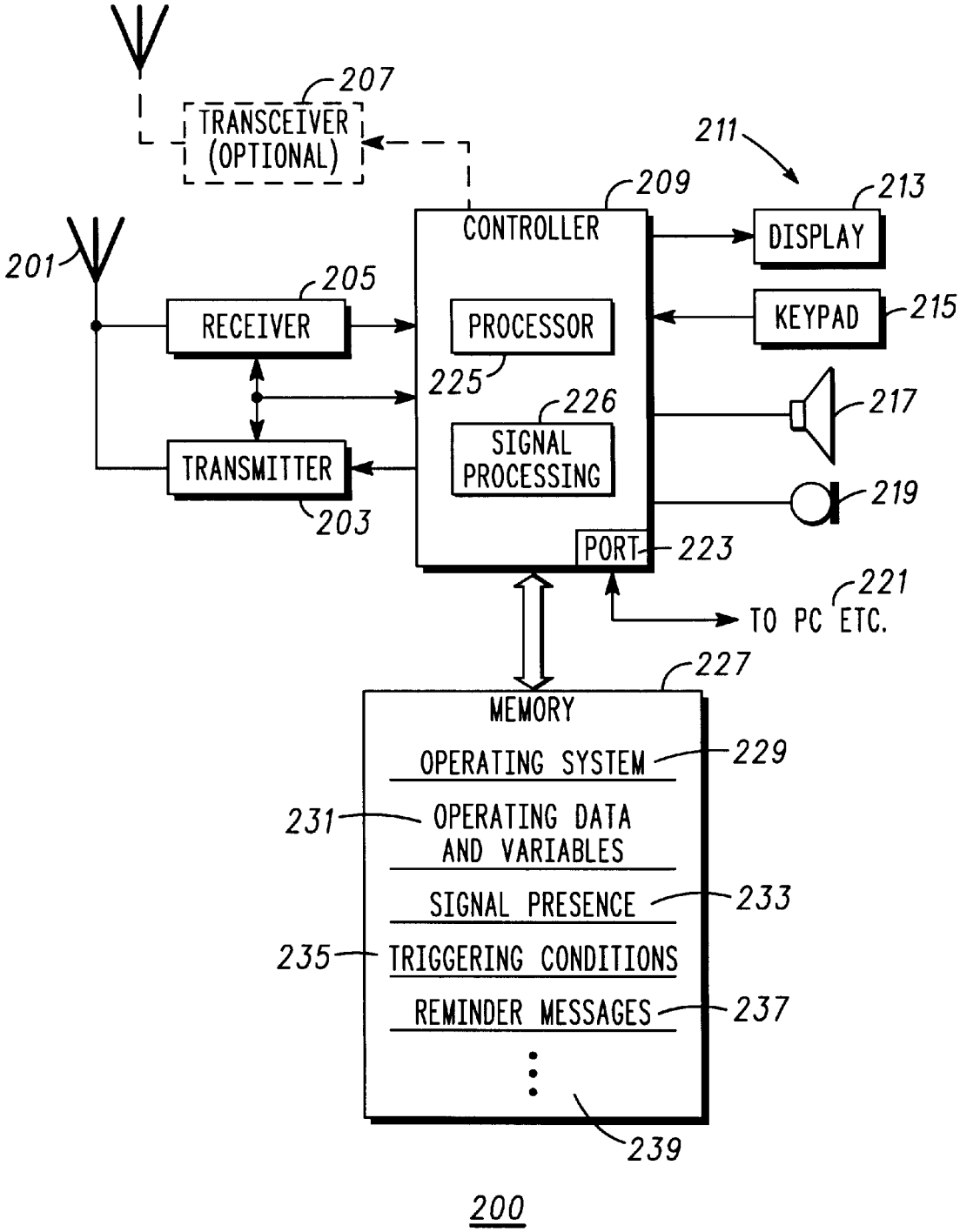
FIG. 2 depicts a block diagram of a preferred embodiment of a user device.

Referring to FIG. 2, a basic block diagram of a preferred embodiment of a user device 200 will be discussed and described. At the level depicted the user device 200 block diagram is similar to many devices with wireless LAN access capabilities that are available from various manufacturers, except for the additional and inventive elements and processes herein described. The functions of many of the blocks are similarly known and will not be dwelled upon. Generally, the block diagram of FIG. 2 depicts a user device 200 that is arranged and constructed for, among other functions, providing a reminder message, where the providing and the message provided may be dependent on the user device environment or changes thereto.

As depicted, the user device 200 includes an antenna structure 201 that may be tunable to one or more frequency bands for radiating radio frequency signals from a transmitter 203 and absorbing or receiving radio frequency signals for a receiver 205. Optionally included is a transceiver 207 that, when provided, allows the device to access other networks. For example, when the device is a cellular handset or subscriber device the transceiver 207 would facilitate access to the wide area network or cellular system or radio access network. The receiver 205 and transmitter 203 are each coupled to a frequency generation unit (FGU) (not depicted) that includes for example one or more known frequency synthesizers that generate signals with frequencies that determine what frequency the receiver is tuned to or what frequency the transmitter transmits on. The optional transceiver 207, receiver 205 and transmitter 203 are inter coupled to a controller 209 (controller and signal processor) by a control signal bus. Additionally the receiver 205 provides a received or base band signal to the controller for received signal processing or decoding and a transmit base band signal is provided by the controller 209 to the transmitter 203 for transmission as required. The controller 209 operates to control the optional transceiver 207, transmitter 203, and receiver 205 and provide proper signals to and from each.

The controller 209 is also inter coupled to a user interface 211 that includes, for example, a display 213, a keyboard 215, a speaker 217 or earpiece, a microphone 219, and other user interface devices 221 such as a vibratory alert apparatus (not shown) or portable computer, via the port 223, all generally known. These elements operate as generally known to provide control and utility to a user of the user device. The user interface will support, via the display and keyboard, user discretionary decisions and inputs as further noted and discussed below.

In any event, the controller 209 comprises a processor 225 and signal processing function that is, preferably, one or more microprocessors and digital signal processors suitable to perform the control and signal processing functions of the user device. The user device further comprises a memory 227, coupled tote controller, that is preferably a combination of RAM, ROM, EEPROM or magnetic based memory. The memory 227 stores software instructions and data that when executed and utilized by the controller or processor results in the controller 209 controlling the user device and processing of signals appropriately. The memory includes a basic operating system 229, operating variables and data 231, signal presence routines or algorithms 233, triggering conditions 235, a plurality of reminder messages 237, and various other routines 239, not specifically depicted, such as algorithms and parameters and routines required to control the user device that are not here relevant but will be understood by one of ordinary skill.

Generally, the user device, as noted above is arranged for providing a reminder message that is dependent on the user device environment. The receiver 205 is for detecting, when present, an external signal, such as a signal from an access point operating according to 802.11 conventions or Bluetooth conventions or the like, where the external signal has a local coverage area that is sufficiently limited to provide resolution of an area where the user device is located. Thus a signal from a LAN is appropriate while a signal from a WAN with a large coverage area is not considered a legitimate external signal for our purposes. The controller 209, specifically the processor 225 executing the proper instructions or routines, is coupled to the receiver 205 and controls the receiver to receive or detect the appropriate external signals. The controller further operates, utilizing the signal presence routines 233, to determine or for determining when the presence of the external signal with local coverage has changed; and for retrieving, if the presence of the external signal has changed, a reminder message, from, for example, the reminder messages in memory 237, that are associated with the user device. The reminder message is coupled by the controller to the user interface 211 that is for providing the reminder message in a user perceptible form, such as an audible form via the speaker 217 or visual form via the display 213 or some combination of both forms as preferred by the user of the user device. For example a short beep or beep-beep followed by a visual presentation may be appropriate.

The controller may determine when the presence of the external signal has changed by further determining tat the receiver is, sequentially, either 1) not detecting the external signal and then more or less immediately thereafter detecting the external signal or 2) detecting the external signal and then more or less immediately thereafter not detecting the external signal. In one aspect the external signal having a local coverage area that is being detected or not detected is from an access point, such as a LAN access point and preferably from an access point that the user device is capable of accessing although this capability of accessing is not strictly necessary. The controller, preferably, retrieves a reminder message that is associated with the user device and that includes substantively information generated by the user or another person and that is further relevant to a location associated with one of availability and absence of the external signal. The reminder message may be retrieved from the memory 237 directly or from an access point, via a server, that is available to the user device. If from an access point, the reminder message may have already been downloaded to the memory 233 or reminder messages 237 location within the memory together with triggering conditions 235 and is thus retrieved from the access point, albeit indirectly.

Some examples will be utilized to more fully expand upon the advantages, concepts, and principles according to the present invention. Suppose for example, the user 141 with the user device 143, 200 leaves home 105 by way of the automobile 107. We would expect a change in the presence of an external signal from the access point 113, specifically this signal would go from being available or detected to being absent or not detected. At the same time the external signal from the access point 115 in the automobile 107 would similarly experience a change in presence, specifically going from not available or absent or not detected to available, etc. Similar or analogous scenarios or situations will occur as the user approaches the work place and moves within the work place. For example when the user approaches or departs the area associated with the office 139 the signal or external signal from the access point 117 and possibly other access points such as access points 119, 123 will come and go or change states between being detected or available and not being detected or absent. If the user departs the office for a meeting in the meeting room 137, we would expect signals, for example, from access points 117, 123, 125, 129 to undergo a change in presence or availability depending on the route the user and user device traverses.

With respect to providing a reminder message, the message should be relevant to the particular signal or the area associated with the signal that has undergone a change in presence. For example, reminder messages relevant to leaving the house, such as "did you remember your assistants gift" or "bring the XYZ magazine article" may be appropriate when a change in presence of the signal from access point 113 is detected. Similarly a message such as "stop and get some bread" or "bring report a-b-c home with you" may be appropriate upon departure from the office for home. These examples also point out that other triggering conditions may be appropriate. For example "pick up milk on the way home" when the user is leaving the office for a meeting may not be appropriate. Many of these can include a time frame trigger. For example, if it is after 5PM and the user is departing the office the pick up milk reminder may be appropriate. Furthermore, a sequence of changes in the presence of multiple and differing external signals may be used as a triggering event to more closely select appropriate reminder messages to fit the situation. For example, departing the office and the work place as signified by a change in the presence of signals from access points 119, 121 after 5PM on Monday through Friday and then getting in the automobile (access point 115) should provide a very good and reliable indication or set of triggering conditions that the user is headed home and thus a reminder to pick up some groceries is very likely to be relevant.

The user device or specifically user interface for providing the reminder message in a user perceptible form further provides the reminder message in either a visual form on the display 213 or an audible form using the audio transducer or speaker 217 if the reminder message is in, or may be converted to, a suitable format. For example, if the reminder message is in an AVI or the like format or a text to speech application is used to process or convert a text message to speech, the reminder message can be provided as an audible message. The user interface may provide the reminder message in the user perceptible form that is a combination of forms, such as two or more of a vibratory alert, an audible form or alert, or a visual form. A reminder message may be presented on the display as well as provided to the speaker or earpiece. For example, one approach that certain users of the user device may find convenient is an audible or vibratory alert, followed by a presentation on the display, and then an audible reproduction of the reminder message via the earpiece, if or when requested via a predetermined key activation sequence, such as "Function plus 1".

The controller may retrieve a reminder message that has been generated by either the user of the user device or by another party. The reminder message is not a message generated by a WAN system intended to portray status, such as type of signal, voice mail pending, and the like, but rather a message the substance of which serves to remind a user of some desired action or event. An individual such as the user or another party, preferably, will originally generate the substance of the reminder message. The user would key in a message or alternatively may record a message with an appropriate key sequence and the microphone and store the message, as keyed or recorded, in memory at and as facilitated by the reminder messages routines 237. The triggering conditions are developed with the assistance of the routines 235 that result in the user device capturing IDs for specific access points when the unit is able to detect the signal from the respective access point. Alternatively the user may enter the IDs from a separately provided list of IDs.

As access point IDs are collected by or entered into the user device, the user can provide a friendly name for each ID such as home, office, work place door, meeting room and the like. A trigger condition or plurality of different trigger conditions can then be developed or specified, preferably, using pull down menus on the display and the keyboard that allow an access point ID or a plurality of IDs to be selected as well as other conditions for each ID (present then absent or vice versa) as well as time, date, day, etc. conditions or constraints. A set of constraints or conditions can be stored as a trigger condition at 235 together with a friendly name, such as leaving home, going to work, leaving work, etc. if desired. One or more of these trigger conditions can be selected and associated with each reminder message as a condition or alternative conditions for the reminder message being provided to the user.

Generation of a reminder message by another user is performed as follows. Another party, such as a family member, can generate the reminder message including the relevant triggering conditions provided access point IDs are available or the stored trigger conditions noted above are available. The family member generates the message "please pick up bread on the way home" and associates the message with a trigger condition or set of constraints, identified as "leaving office" and sends the message to the user via the Internet and email. The message is downloaded to the user device and is triggered and provided to the user of the device at the proper time.

In summary we have discussed and described, with reference to FIGS. 1 and 2, a user device 200 that is arranged and constructed for providing a user with a reminder message upon arrival or departure from a predetermined area and possibly satisfaction of other constraints. The user device 200 comprises a user interface 211, preferably, including a keypad 215 and display 213; a controller 209 that is coupled to the user interface and further includes or is coupled to a memory 227 and that facilitates generation of a reminder message by a user and storing the reminder message together with triggering information or conditions comprising availability and absence of one or more external signals and possibly other parameters; and a receiver 205, coupled to the controller, for detecting the availability or absence of these external signals. The controller is operable for retrieving the reminder message and providing a visual indication or audible indication of the reminder message on the display or via the speaker when a comparison of the triggering information to a pattern of the availability and absence of the external signal is favorable.

Figure 3:
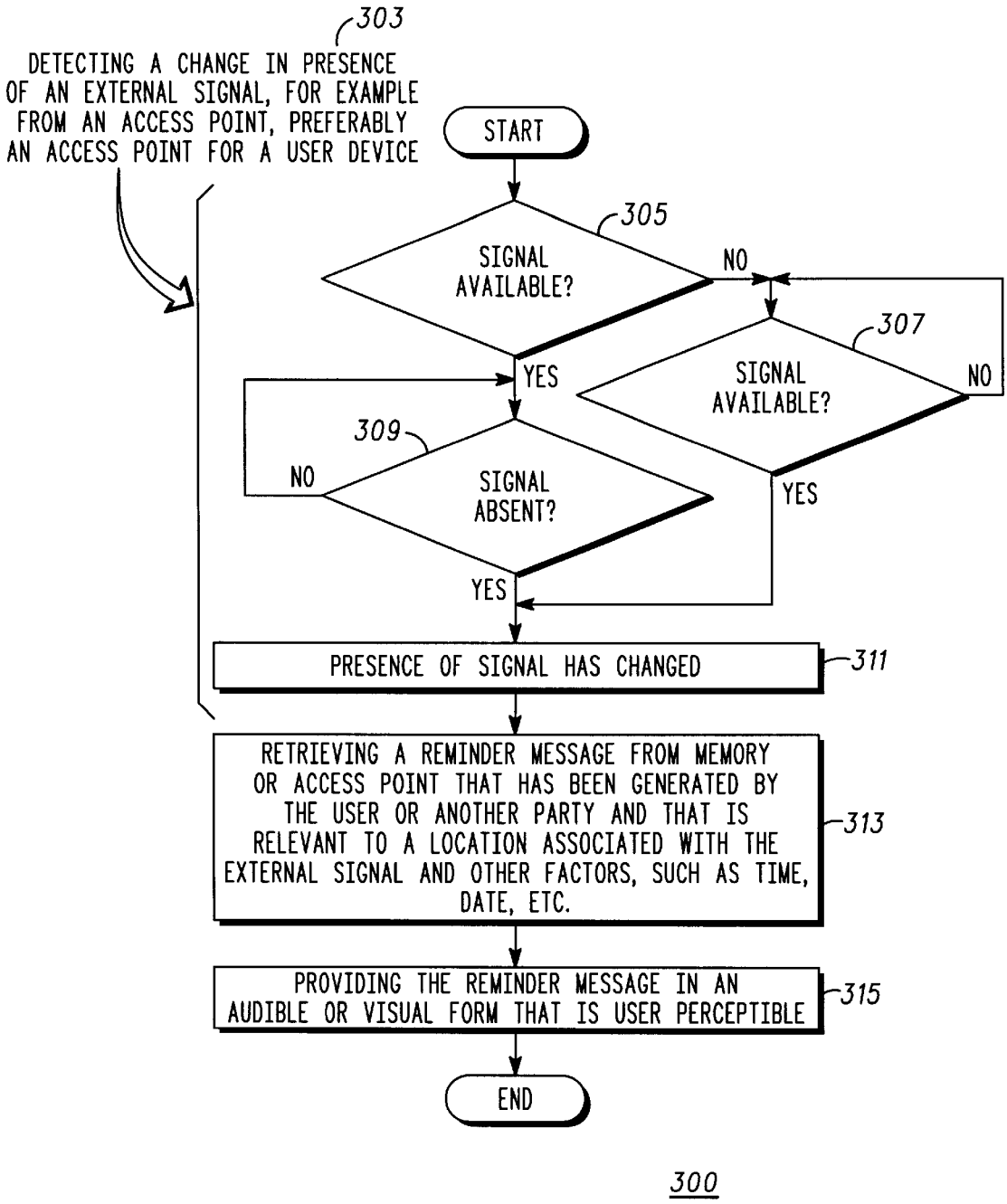
FIG. 3 illustrates a flow chart of a preferred method embodiment of providing reminder messages for a user.

Referring to FIG. 3, a flow chart of a preferred method embodiment of providing reminder messages for a user will be discussed and described. Much of this discussion will be in the nature of a review as many of the concepts and principles have been discussed above. FIG. 3 shows a method 300 of providing a reminder message that is dependent on a user device environment. The method 300 begins and at 303 detects a change in a presence of an external signal, such as the signal from an access point that is preferably an access point for the user device. The process of 303 maybe accomplished in one fashion with the procedures depicted in 305–311.

At 305 it is determined whether the signal is available or detected. If the signal is not detected indicating that it is not available or absent, then 307 retests the same condition until the signal becomes available or is detected. If the signal is available or detected at 305, then 309 tests whether the signal is now absent or unavailable and continues to do so until the signal is absent or not detected. Note that this may be the same test as performed at 305 and 307 with the indicated yes/no logic flows reversed. In any event if at 309 the signal is now absent or if at 307 the signal is now available, 311 indicates that the presence of the signal has now changed. For each signal or external signal where a change in presence is of interest the procedures of 305–311 will operate in parallel. Also it will be noted that the state at the output of 305, either yes or no, or the no state at the output of 307 and 309 should be retained through, for example, an on/off power cycle in order to avoid an anomaly in performance of the process.

In this manner, the detecting a change in the presence of the external signal comprises either 1) not detecting the external signal followed by detecting the external signal and 2) detecting the external signal followed by not detecting the external signal. As noted the external signal that is being detected or not detected, is preferably from an access point for a LAN and this access point is preferably one for the user device or one that the user device may access.

Next at 313, retrieving a reminder message associated with the user device is undertaken. This preferably includes retrieving a reminder message relevant to a location associated with one of availability and absence of the external signal and possibly other conditions or circumstances. This reminder message may be from a memory within the user device or alternatively from an access point for the user device where the access point is possibly the source of the external signal. The reminder message is not a system generated message or status message but rather may be one that has been generated by the user of the user device or another party. At 315, providing the reminder message in a user perceptible form is shown. As noted above, the reminder message may be provided in a visual form on a display of the user device or an audible form using a speaker of the user device or some combination of both and other forms. After 315 the process ends but it is noted that the method is repetitive and recycles over and over.

The processes and apparatus discussed above and the inventive principles and concepts thereof are intended to and will alleviate problems caused by prior art systems for providing reminder messages. Using these principles of detecting or determining a change in the presence, availability or absence, of one or more external signals to trigger or initiate the retrieval of a reminder message that is situation specific for the user device, such as a cellular handset, personal digital assistant, or the like, or user thereof, will enable the user thereof to enjoy not only the reminder message at an appropriate moment but also benefits such as lower cost for user devices since an extra GPS receiver is not required as well as longer battery life thus facilitating user satisfaction. It is expected that one of ordinary skill given the above described principles, concepts and examples will be able to implement other alternative procedures that are subscriber or wireless unit or system characteristic dependent and that will also offer or facilitate similar performance benefits. It is expected that the claims below cover most such alternatives.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A method of providing a reminder message dependent on a user device environment, the method comprising:

detecting a change in a presence of an external signal, the external signal provided by an access point included in a local area network;

retrieving a reminder message associated with the user device; and providing the reminder message in a user perceptible form.

2. The method of claim 1, wherein the detecting a change in the presence of the external signal further comprises one of not detecting the external signal followed by detecting the external signal and detecting the external signal followed by not detecting the external signal.

3. The method of claim 2, wherein the not detecting the external signal followed by detecting the external signal further comprises not detecting the external signal from the access point followed by detecting the external signal from the access point.

4. The method of claim 3, wherein the detecting the external signal from the access point further comprises detecting the external signal from an access point for the user device.

5. The method of claim 2, wherein the retrieving a reminder message associated with the user device further includes retrieving a reminder message relevant to a location associated with one of availability and absence of the external signal.

6. The method of claim 5, wherein the retrieving a reminder message relevant to a location associated with one of the availability and the absence of the external signal further comprises retrieving the reminder message from a memory within the user device.

7. The method of claim 5, wherein the retrieving a reminder message relevant to a location associated with one of the availability and the absence of the external signal further comprises retrieving the reminder message from an access point for the user device, the access point for the user device further being the source of the external signal.

8. The method of claim 1, wherein the providing the reminder message in a user perceptible form further comprises providing the reminder message in one of a visual form on a display of the user device and an audible form using a speaker of the user device.

9. The method of claim 1, wherein the providing the reminder message in a user perceptible form further comprises providing the reminder message in a combination of an audible and a visual form.

10. The method of claim 1, wherein the retrieving the reminder message further includes retrieving a reminder message that has been generated by one of a user of the user device and another party.

11. A user device, arranged for providing a reminder message dependent on the user device environment, the user device comprising:

a receiver for detecting, when present, an external signal, the external signal provided by a first access point included in a local area network;

a controller, coupled to the receiver, for:

determining when the presence of the external signal has changed; and retrieving, if the presence of the external signal has changed, a reminder message associated with the user device; and a user interface, coupled to the controller, for providing the reminder message in a user perceptible form.

12. The user device of claim 11, wherein the controller for the determining when the presence of the external signal has changed is further for determining that the receiver is, sequentially, one of:

not detecting the external signal and then detecting the external signal; and detecting the external signal and then not detecting the external signal.

13. The user device of claim 12, wherein the controller for determining that the receiver is, sequentially, not detecting the external signal and then detecting the external signal is further for determining that the receiver is, sequentially, not detecting the external signal from the first access point followed by detecting the external signal from the first access point.

14. The user device of claim 13, wherein the controller for determining that the receiver is detecting the external signal from the first access point further comprises detecting the external signal from an access point that the user device is capable of accessing.

15. The user device of claim 12, wherein the controller for retrieving the reminder message associated with the user device is further for retrieving a reminder message relevant to a location associated with one of availability and absence of the external signal.

16. The user device of claim 15, further comprising a memory and wherein the controller for retrieving the reminder message relevant to the location associated with one of the availability and the absence of the external signal is further for retrieving the reminder message from the memory.

17. The user device of claim 15, wherein the controller for retrieving the reminder message relevant to the location associated with one of the availability and the absence of the external signal is further for retrieving a reminder message from an access point available to the user device.

18. The user device of claim 11, further comprising a display and an audio transducer and wherein the user interface for providing the reminder message in a user perceptible form is further for providing the reminder message in one of a visual form on the display and art audible form using the audio transducer.

19. The user device of claim 11, wherein the user interface for providing the reminder message in the user perceptible form is further for providing the reminder message in a combination of an audible and a visual form.

20. The user device of claim 11, wherein the controller for retrieving the reminder message is further for retrieving a reminder message that has been generated by one of the user and another party.

21. A user device arranged and constructed for providing a user with a reminder message upon arrival or departure from a predetermined area, the user device comprising:

a user interface comprising a keypad and display;

a controller, coupled to the user interface and further comprising a memory, for facilitating generation of a reminder message by a user and storing the reminder message together with triggering information comprising availability and absence of an external signal; and a receiver, coupled to the controller, for detecting the availability and absence of the external signal, the external signal provided by an access point included in a local area network, wherein the controller is operable for retrieving the reminder message and providing a visual indication of the reminder message on the display when a comparison of the triggering information to a pattern of the availability and absence of the external signal is favorable.

* * * * *

UNITED STATES PATENT AND TRADEMARK OFFICE

CERTIFICATE OF CORRECTION

PATENT NO. : 6,819,256 B2
DATED : November 16, 2004
INVENTOR(S) : Art Hampton

It is certified that error appears in the above-identified patent and that said Letters Patent is hereby corrected as shown below:

Column 10,
Line 31, please delete “art” and insert -- an --.

Signed and Sealed this

Third Day of May, 2005

JON W. DUDAS
*Director of the United States Patent and Trademark Office*